US005886604A

United States Patent [19]

Kume

[11] Patent Number: 5,886,604

[45] Date of Patent: Mar. 23, 1999

[54] CIRCUIT BREAKER

[75] Inventor: Masahiro Kume, Nagoya, Japan

[73] Assignees: Harness System Technologies Research, Ltd.,, Nagoya; Sumitomo Wiring Systems, Ltd., Yokkaichi; Sumitomo Electric Industries, Ltd., Osaka, all of Japan

[21] Appl. No.: 25,869

[22] Filed: Feb. 19, 1998

[30] Foreign Application Priority Data

Feb. 20, 1997 [JP] Japan ..... 9-36042

[51] Int. Cl.[6] ..... H01H 9/00

[52] U.S. Cl. ..... 335/172; 335/177

[58] Field of Search ..... 335/23–25, 167–177, 335/178, 179; 200/43.11, 43.14, 43.15

[56] References Cited

U.S. PATENT DOCUMENTS 2,443,991 6/1948 Penniman ..... 335/177

5,468,925 11/1995 Mohsen ..... 200/43.16

5,684,443 11/1997 Runyan et al. ..... 335/177

FOREIGN PATENT DOCUMENTS 1-166435 6/1989 Japan .

*Primary Examiner*—Lincoln Donovan

*Attorney, Agent, or Firm*—Oliff & Berridge, PLC

[57] ABSTRACT

A circuit breaker having superior shock and vibration resistance is provided. The circuit breaker has a handle pivoted from an off position to an on position. The circuit is closed by bringing a movable contact point into contact with a fixed contact point via lever mechanisms. The circuit breaker has an electromagnetic coil which holds the movable iron piece in a non-attraction position away from an electromagnetic trip coil until power is applied to the electromagnetic trip coil. When the movable iron piece is attracted to the electromagnetic trip coil, the lever mechanisms are released from the constrained state, and the movable contact point is separated from the fixed contact point to thereby open the circuit, and the handle returns to the off position in conjunction with the lever mechanisms.

9 Claims, 5 Drawing Sheets

CIRCUIT BREAKER

BACKGROUND OF THE INVENTION

1. Field of the Invention

The present invention relates to a circuit breaker having superior shock and vibration resistance.

2. Discussion of Related Art

As shown in FIG. 6, a circuit breaker having the following configuration has already been proposed (see Japanese Patent Application Laid-open No. Hei-1-166435). Specifically, when a handle 1 is pivoted from an off (OFF) position to an on (ON) position, a circuit is closed by bringing a movable contact point into contact with a fixed contact point via a lever mechanism A. Further, the lever mechanism A and the handle 1 are constrained in the ON position. In contrast, when a movable iron piece 3 is attracted to an electromagnetic trip coil 2 by application of a signal such as an overcurrent to the electromagnetic coil 2, the lever mechanism A is released from the constrained state, and the movable contact point is separated from the fixed contact point, thereby opening the circuit. Further, the handle 1 returns to the OFF position in conjunction with the lever mechanism A.

In a case where the foregoing circuit breaker is provided on an automobile, the movable iron piece 3 moves in the direction-in which it is supposed to be attracted to the coil-due to abnormal physical shock or vibration, whereby the lever mechanism A is accidentally released from a constrained state. As a result, the movable contact point is separated from the fixed contact point, thereby resulting in a risk of the circuit breaker erroneously carrying out tripping action.

Such a problem may be avoided, so long as a spring 4 is provided for holding the movable iron piece 3 in a non-attraction position more firmly, and the spring force of the spring 4 is increased. However, the electromagnetic trip coil 2 is required to have an attracting force sufficient to overcome the spring force, thereby rendering the circuit-breaking operation of the breaker unstable and resulting in a decrease in the reliability of the circuit breaker.

The handle 1 itself is pivoted from the ON position to the OFF position due to abnormal physical shock or vibration. Accordingly, there may arise a risk of the circuit breaker erroneously causing a tripping operation, as in the foregoing case.

SUMMARY OF THE INVENTION

The present invention has been conceived to solve the aforementioned drawback in the prior art, and an object of the present invention is to provide a circuit breaker having superior shock and vibration resistance.

To solve the foregoing and other problems, the present invention provides a circuit breaker in which when a handle is pivoted from an off position to an on position, a circuit is closed by bringing a movable contact point into contact with a fixed contact point via lever mechanisms, and the lever mechanisms and the handle are constrained in the on position, whereas when a movable iron piece is attracted to an electromagnetic trip coil by application of power to the electromagnetic coil, the lever mechanisms are released from the constrained state, and the movable contact point is separated from the fixed contact point, thereby opening the circuit, and the handle returns to the off position in conjunction with the lever mechanisms, the circuit breaker also including:

an electromagnetic coil which holds the movable iron piece in a non-attraction position until power is applied to the electromagnetic trip coil.

BRIEF DESCRIPTION OF THE DRAWINGS

FIG. 4 shows a modification of the lock member, wherein

DETAILED DESCRIPTION OF PREFERRED EMBODIMENTS

According to the present invention, when the handle is pivoted to the on position from the off position to thereby close the circuit, the lever mechanisms and the handle are constrained in the on position. In this state, no power is applied to the electromagnetic trip coil. However, power is applied to the electromagnetic coil for holding purpose, so that the movable iron piece is held in the non-attraction position.

As mentioned above, since the movable iron piece is firmly held in the non-attraction position by means of the electromagnetic coil for holding purpose, the movable iron piece is prevented from moving in the attracting direction due to abnormal physical shock or vibration without the need of a spring used for the purpose of retaining the movable iron piece in the non-attraction position.

Preferably, a lock member for constraining the handle in the on position is provided on a housing, thereby preventing pivoting of the handle itself to the off position which would otherwise be caused by abnormal physical shock or vibration.

By reference to the accompanying drawings, an embodiment of the present invention will be described in detail.

Figure 1:
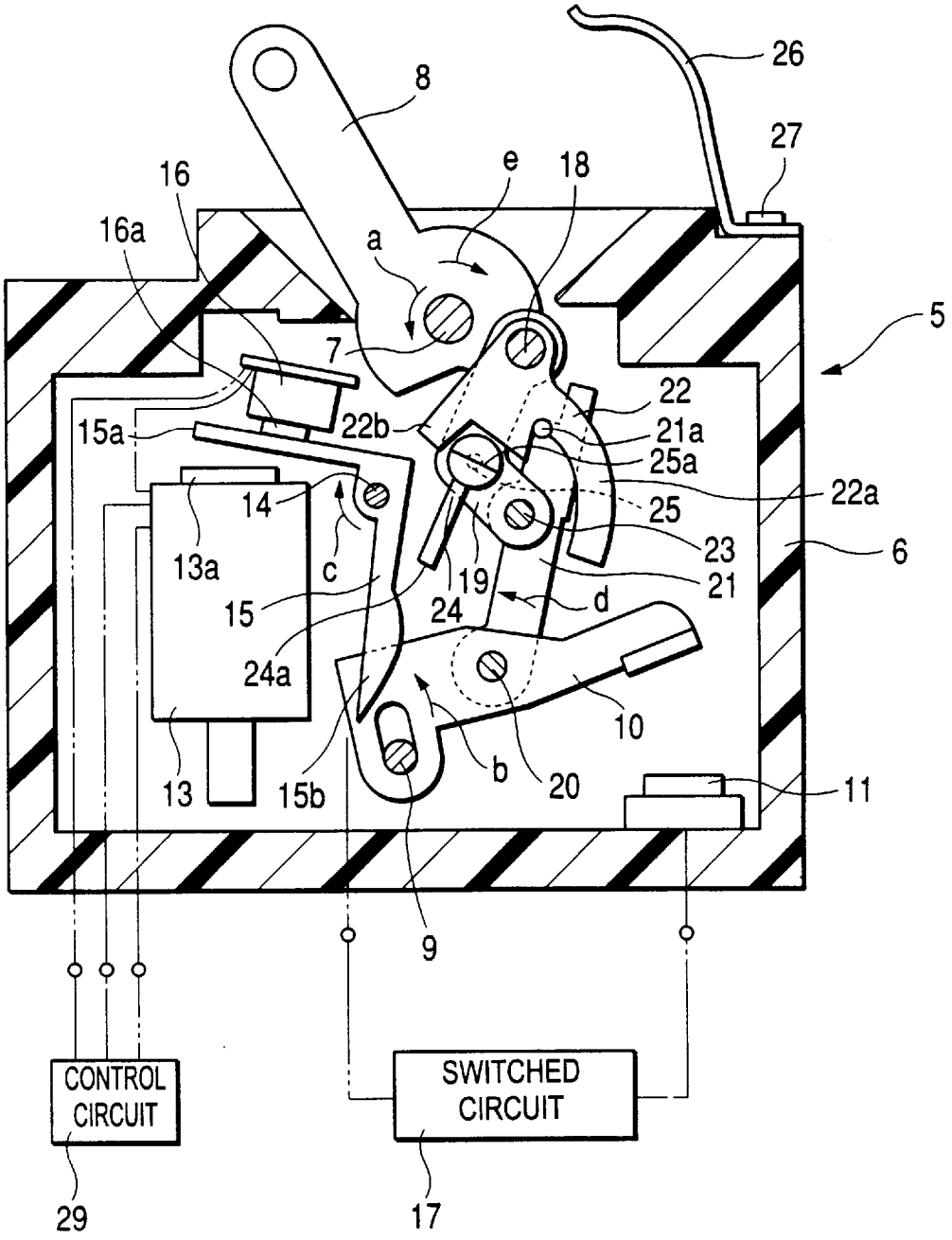
FIG. 1 is a front view showing an initial state of a circuit breaker according to the present invention.

As shown in FIG. 1, a circuit breaker 5 is provided with a housing 6. A handle 8 is provided in upper internal space of the housing 6 and is supported by a handle shaft 7 mounted on the internal side wall of the housing 6 so as to be pivotal. The handle 8 is forced so as to pivot to the leftward direction designated by "a" (or toward the off position) by means of a spring (not shown).

In the lower internal space of the housing 6, a movable contact point 10 is supported by a contact point shaft 9 mounted on the internal side wall of the housing 6 so as to be vertically pivotable and slightly movable. When the contact point 10 is pivoted upwardly (see FIGS. 1 and 3A), the contact point is separated from a fixed contact point 11 provided on the internal bottom wall of the housing 6, thereby turning off the circuit breaker. In contrast, when the contact point 10 is pivoted downwardly (see FIG. 2A), the contact point comes into contact with the fixed contact point 11, thereby turning on the circuit breaker. The movable contact point 10 is forced in the direction-in which it is upwardly pivoted (or toward the off position) by means of a spring (not shown).

An electromagnetic trip coil 13 is mounted on the internal side wall of the housing 6, and an inverted L-shaped movable iron piece 15 is supported at the side of the electromagnetic trip coil 13 in such a way as to be vertically pivotable by means of an iron piece shaft 14 mounted on the internal side wall of the housing 6. When power is applied to the electromagnetic trip coil 13, an upper arm 15*a* is pivotally attracted to an internal iron core 13*a* of the electromagnetic trip coil 13. In contrast, when no power is applied to the electromagnetic trip coil 13, the upper arm 15*a* is forced in an upward pivotal direction designated by "c" by means of a spring (not shown).

An electromagnetic coil 16 for holding purpose is mounted on the internal side wall of the housing 6 in a position above the electromagnetic trip coil 13. When power is applied to an internal iron core 16*a* of the electromagnetic coil 16 for holding purpose, the upper arm 15*a* of the movable iron piece 15 forced in the upward pivotal direction "c" is attracted to and retained in an upward pivotal position by the electromagnetic coil 16.

An upper portion of a C-shaped first link 19 is joined to a lower portion of the handle 8 so as to be pivotal by means of a first link shaft 18. A lower portion of an I-shaped second link 21 is joined to an intermediate portion of the movable contact point 10 so as to be pivotal by means of a second link shaft 20. Further, a lower portion of the first link 19 and the intermediate portion of the second link 21 are joined together so as to be pivotal by means of a third link shaft 23. The second link 21 is forced in a leftward pivotal direction designated by "d" by means of a spring (not shown).

A lock pin 21a is provided at an upper portion of the second link 21, and the first link shaft 18 is joined to an upper portion of the circular-arc-shaped cam lever 22 together with an upper portion of the first link 19 in such a way that the upper portions of the cam lever 22 and the first link 19 are pivotal. A lock recess 22*c* (see FIG. 3A) is formed between the circular-arc-shaped section 22*a* and the cam 22*b* of the cam lever 22. A lock pin 21*a* of the second link 21 which travels along the internal edge of the circular-arc-shaped section 22*a* engages with the lock recess 22*c* from above, thereby temporarily constraining the second link 21 in the substantially-vertical leftward pivotal position.

The intermediate portion of the striker bar 24 is supported on the intermediate portion of the first link 19 in such a way as to be pivotal by means of a bar shaft 25 integrally formed with the striker bar 24. When the handle 8 is pivoted toward the rightward direction designated by "e" (i.e., toward the on position), a lower portion 24*a* of the striker bar 24 (an upper portion of the striker bar 24 is omitted from the drawing) approaches and becomes opposite to a lower arm 15*b* of the movable iron piece 15 whose upper arm 15*a* is retained in the upward pivotal position by means of the electromagnetic coil 16. The striker bar 24 is forced in a rightward pivotal direction by means of a spring (not shown).

A top-flat semicircular shear pin 25*a* is integrally formed with the bar shaft 24 of the striker bar 24. As represented by an enlarged view shown in FIG. 2B, the cam 22*b* of the cam lever 22 is constrained by a shoulder 25*b* of the shear pin 25*a*, whereby the cam lever 22 is temporarily held so as not to pivot in the leftward direction.

A lock member 26 formed into the shape of a leaf spring is mounted on the upper outside of the housing 6. When the handle 8 is actuated in the right pivotal direction "e" (i.e., toward the on position), the lock member 26 holds the handle 8 in the rightward pivotal position (i.e., the on position).

Figure 5:
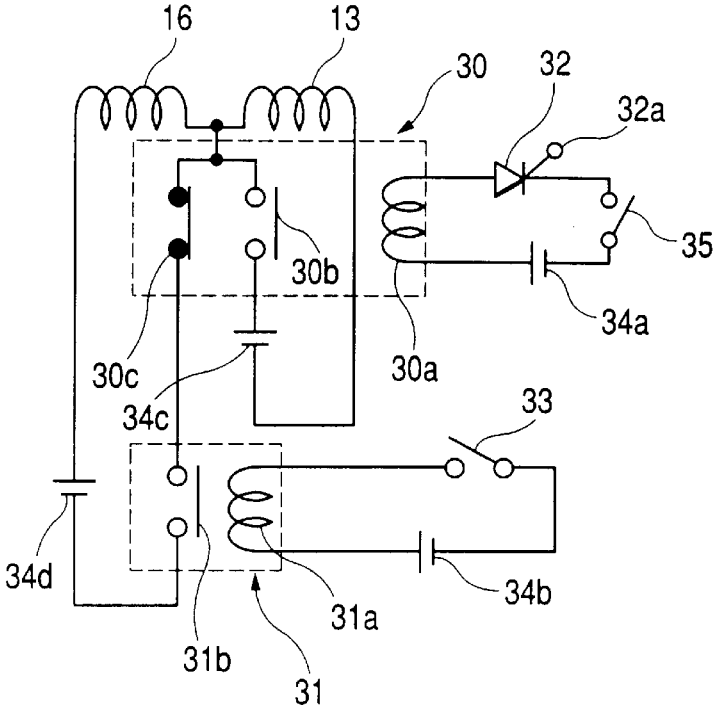
FIG. 5 is a circuit diagram showing an electromagnetic coil.
Figure 6:
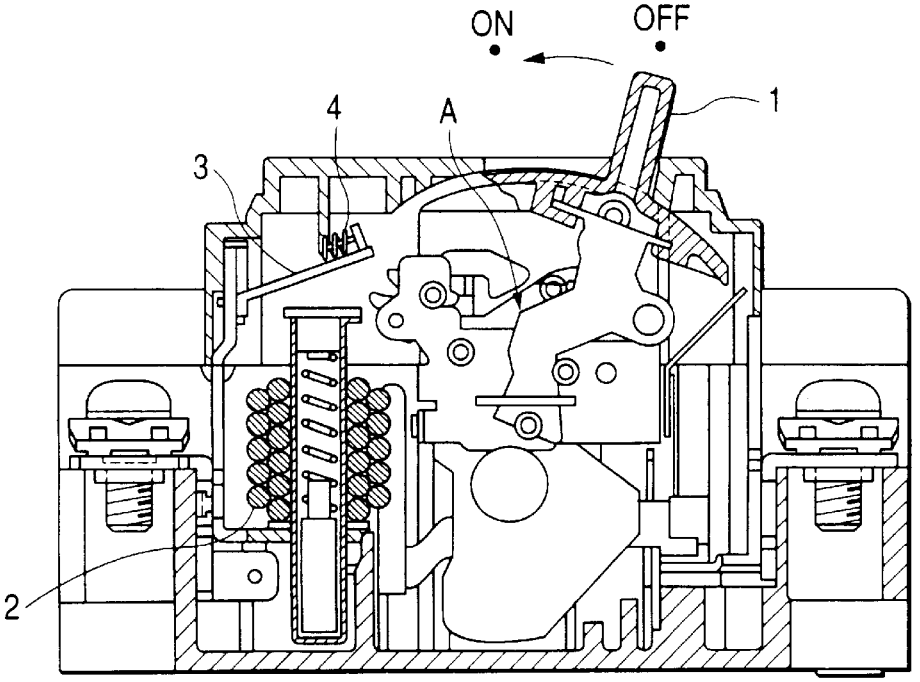
FIG. 6 PRIOR ART
FIG. 6 is a front view showing an existing circuit breaker.

FIG. 5 is a control circuit of the circuit breaker 5, and a trip relay 30 comprises a coil 30*a*, a normally-open contact point "a" 30*b*, and a normally-close contact point "b" 30*c*. Further, a relay 31 for retaining purpose comprises a coil 31*a* and a normally-open contact point "a" 31*b*.

A semiconductor switch 32 is connected to the coil 30*a* of the trip relay 30 and is controlled between an on state and an off state by means of a control signal output from a gate 32*a*. Reference numerals 33 and 35 designate external switches, and reference numerals 34*a* to 34*d* designate power sources.

The operation of the circuit breaker 5 having the foregoing construction will be described hereinbelow. As shown in FIG. 1, when the handle 8 is pivoted in the leftward direction to the off position by means of spring force, the movable contact point 10 is upwardly pivoted to the off position. In this state, since no power is applied to the electromagnetic trip coil 13, the movable iron piece 15 is upwardly pivoted by means of spring force.

At this time, when the external switch 33 is turned on in association with the actuation of, e.g., an ignition switch of an automobile, power is applied to the coil 31*a* of the relay 31, thereby turning on the contact point "a" 31*b*. Power is further applied to the electromagnetic coil 16 via the contact point "b" 30*c* of the trip relay 30. Therefore, the upper arm 15*a* of the movable iron piece 15 is attracted to and retained by the electromagnetic coil 15 in the upward pivotal position.

Figure 2A:
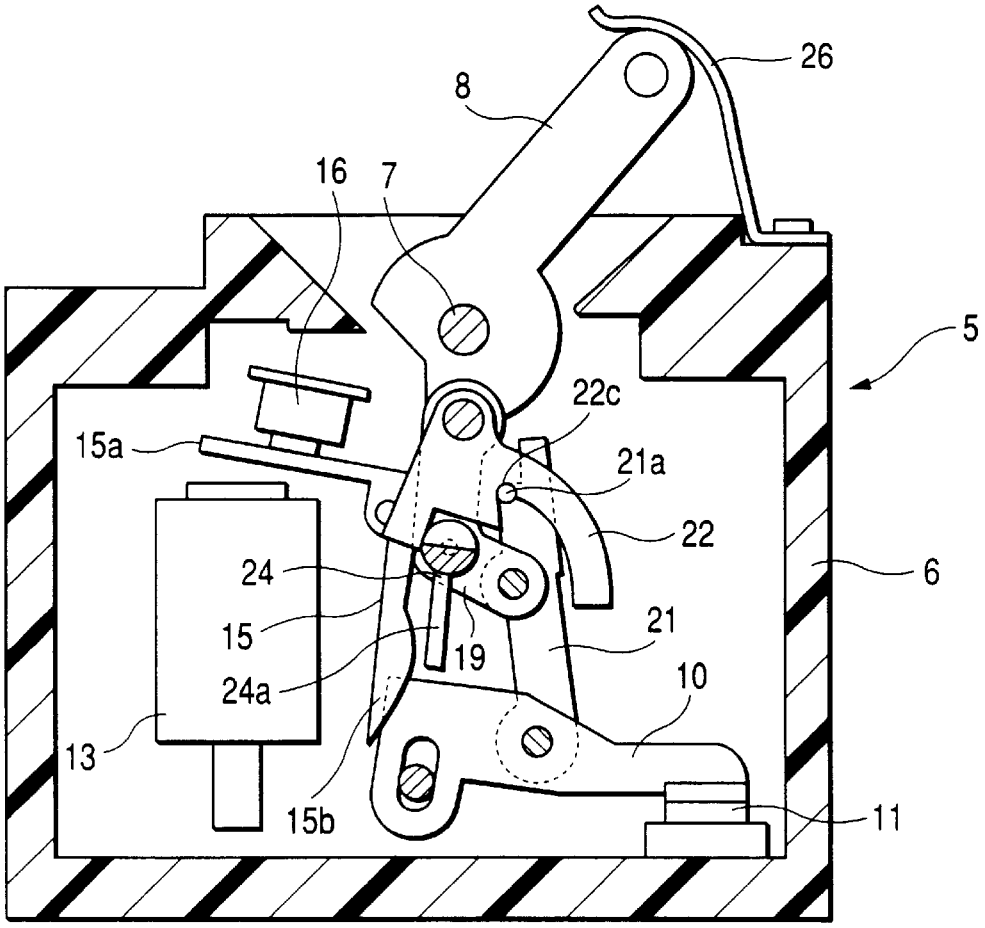
FIG. 2A is a front view showing a circuit breaker which is in a set condition.

As shown in FIG. 2A, when the handle 8 is actuated and pivoted right from the foregoing initial state, the handle 8 itself is constrained in the rightward pivotal position (i.e., the on position) by means of the lock member 26. The movable contact point 10 is lowered by way of the first link 19 and the second link 21, thereby coming into contact with the fixed contact point 1. As a result, a circuit 17 is closed.

Figure 2B:
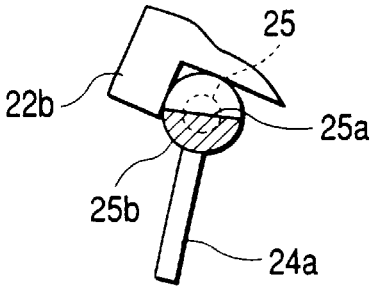
FIG. 2B is an enlarged view showing the principal elements of the circuit breaker shown in FIG. 2A.

At this time, the cam lever 22 whose lock recess 22*c* is engaged with the lock pin 21*a* of the second link 21 is rotated right about the handle shaft 7 and pivots right on the first link shaft 18 in association with the rightward pivotal movement of the handle 8 and the second link 21. As shown in FIG. 2B, the cam 22*b* is constrained by the shoulder 25*b* of the shear pin 25*a* of the bar shaft 25 of the striker bar 24, so that the cam lever 22 is temporarily retained so as not to pivot in the leftward direction. The lower portion 24*a* of the striker bar 24 supported on the first link 19 by the bar shaft 25 approaches and becomes opposite to the lower arm 15*b*.

Although no power is applied to the electromagnetic trip coil 13 in this set condition, power is applied to the electromagnetic coil 16, and the movable iron piece 15 is firmly retained in the non-attraction position. Therefore, the movable iron piece 15 is prevented from moving in the attracting direction due to abnormal physical shock or vibration without the need of a spring used for the purpose of firmly retaining the movable iron piece 15 in the non-attraction position.

As a result, there is no risk of the circuit breaker 5 erroneously performing tripping action, thereby resulting in stable circuit-breaking operation with improved reliability.

Further, the handle 8 is constrained in the on position by means of the lock member 26, and hence the handle 8 itself is prevented from pivoting to the off position due to abnormal physical shock or vibration. Therefore, there is no risk of the circuit breaker 5 erroneously performing tripping action. If the circuit breaker employs the electromagnetic coil 16 together with the lock member, the reliability of the circuit breaker is improved further.

When a signal, such as an overcurrent, is applied to the gate 32*a* of the semiconductor switch 32 from the control circuit 29 while the external switch 35 is in an on state, the semiconductor switch 32 is turned on, and power is applied to the coil 30*a* of the electromagnetic trip coil 30. As a result, the contact point "b" 30*c* is turned off the instant the contact point "a" 30*b* is turned on, the power applied to the electromagnetic coil 16 is interrupted. The upper arm 15*a* of the movable iron piece 15 is released from a retained state, and power is applied to the electromagnetic trip coil 13, whereby the upper arm 15*a* of he movable iron piece 15 is attracted to and held by the electromagnetic trip coil 13.

Figure 3A:
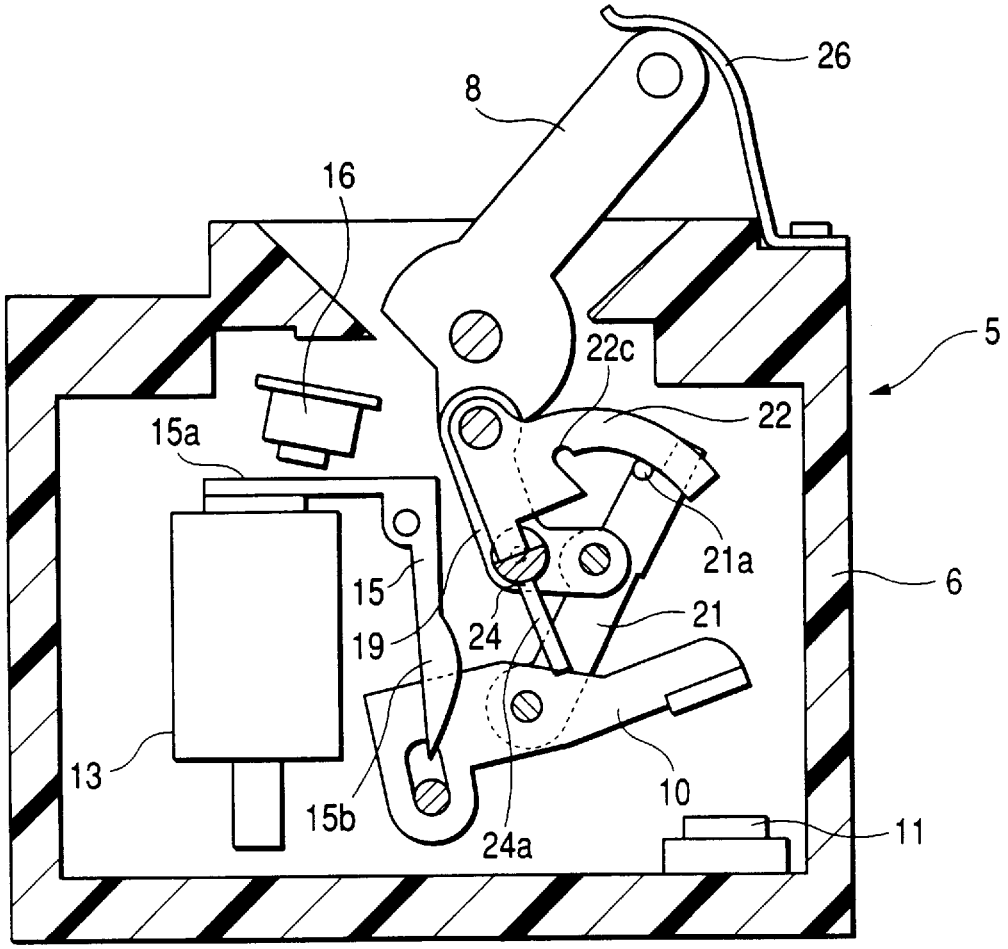
FIG. 3A is a front view showing a circuit breaker which is in a broken condition.
Figure 3B:
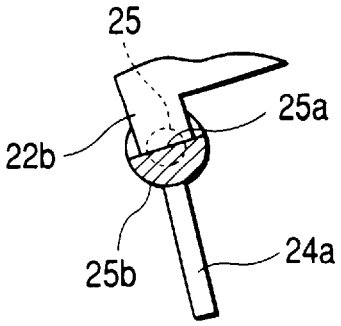
FIG. 3B is an enlarged view showing the principal elements of the circuit breaker shown in FIG. 3A.

As shown in FIGS. 2A and 3A, the movable iron piece 15 is pivoted left, and the lower arm 15*b* pivots the lower portion 24*a* of the striker bar 24 in the leftward direction. Therefore, as shown in FIG. 3B, the cam 22*b* of the cam lever 22 is released from the shoulder 25*b* of the shear pin 25*a*, and the cam lever 22 is pivoted leftward by means of spring force, to thereby disengage the lock pin 21*a* from the lock recess 22*c*. The second link 21 is pivoted right by means of spring force, and the movable contact point 10 is upwardly pivoted by spring force. As a result, the movable contact point 10 is separated from the fixed contact point 11, thereby opening the circuit 17.

Subsequently, in the case where the circuit 17 is closed again, when the handle 8 is forcefully pivoted left until it is disengaged from the lock member 26, the handle 8 returns to the initial state shown in FIG. 1. If the handle 8 is pivoted right again, the circuit 17 can be closed repeatedly in the manner as described previously.

Figure 4A:
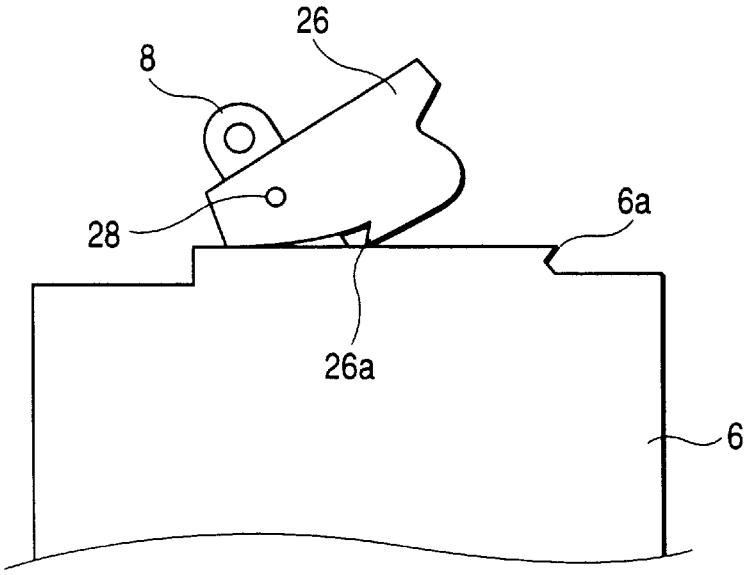
FIG. 4A is a front view showing the lock member when in an initial state.
Figure 4B:
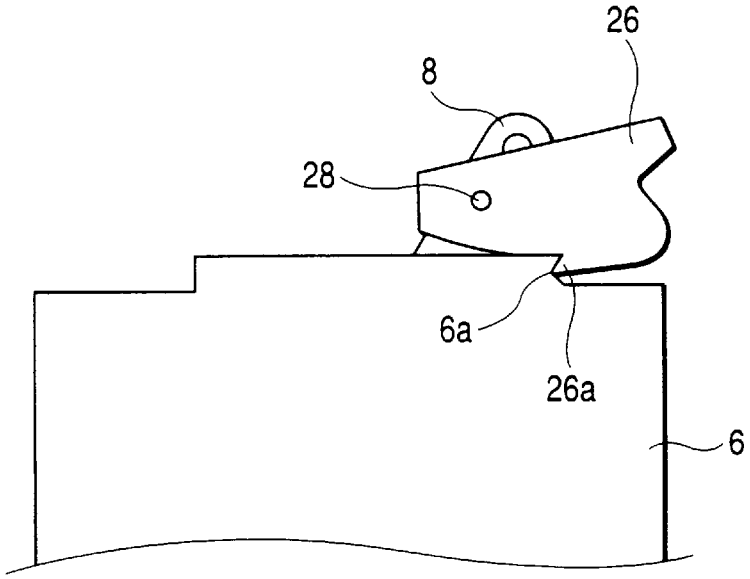
FIG. 4B is a front view showing the lock member when in a set condition.

Although the lock member 26 that is in the form of a leaf spring is mounted on the upper external portion of the housing 6 by means of a screw 27 in the foregoing embodiment, a leaf-shaped lock member 26 made of synthetic resin may be supported on an upper portion of the handle 8 so as to be vertically pivotal by means of a pin 28 as shown in FIG. 4A. Further, a lock recess 6*a* is formed in the upper external portion of the housing 6 in such a way that a pawl 26*a* of the lock member 26 is locked when the handle 8 is pivoted right. The handle 8 may be constrained in the rightward pivotal position.

Further, although power is applied to the electromagnetic trip coil 13 the instant the power applied to the electromagnetic coil 16 is interrupted in the previous embodiment, if power is applied to the electromagnetic trip coil 13 after lapse of a given period of time since the power applied to the electromagnetic coil 16 has been interrupted, the attracting force of the electromagnetic trip coil 13 becomes effective after the attracting force of the electromagnetic coil 16 has sufficiently disappeared. The breaking action of the circuit breaker 15 is ensured further.

As mentioned in the previous embodiment, when the external switch 33 is turned on in association with the actuation of the ignition switch, the external switch 33 can be turned on by actuation of the ignition switch. As a result, the external switch 33 can be accurately turned on only when a circuit-breaking operation is required.

As is evident from the foregoing description, in the circuit breaker according to the present invention, when the handle is actuated and pivoted to the on position from the off position to thereby close the circuit, power is applied to the electromagnetic coil for holding purpose, so that the movable iron piece is firmly held in the no-attraction position. Accordingly, the movable iron piece is prevented from moving in attracting direction due to abnormal physical shock or vibration without provision of a spring used for the purpose of firmly holding the movable iron piece in the non-attraction position (or even in a case where the pivotal spring force exerted on the movable iron piece toward the non-attraction position is weak), thereby eliminating the risk of the circuit breaker erroneously performing tripping action. Therefore, the breaking action of the circuit breaker becomes more stable, resulting in improvement in reliability of the circuit breaker.

Further, if the lock member for constraining the handle in the on position is provided on the housing, the handle itself is prevented from pivoting to the off position due to abnormal physical shock or vibration. Similarly, there is no risk of the circuit breaker erroneously performing tripping action. Hence, if the circuit breaker employs the electromagnetic coil for holding purpose together with the lock member, the reliability of the circuit breaker is improved further.

What is claimed is:

1. A circuit breaker, comprising;

a handle pivotable between an off position and an on position, lever mechanisms in association with the handle and controlling a movable contact point, a fixed contact point, a movable iron piece, an electromagnetic trip coil and an electromagnetic holding coil;

wherein when the handle is pivoted to the on position, a circuit is closed by bringing the movable contact point into contact with the fixed contact point via the lever mechanisms, the electromagnetic holding coil holds the movable iron piece in a non-attraction position away from the electromagnetic trip coil and in a non-contacting state away from the lever mechanisms until power is applied to the electromagnetic trip coil, and the lever mechanisms and the handle are constrained in the on position; and wherein when the movable iron piece is attracted to the electromagnetic trip coil by application of power to the electromagnetic trip coil, the lever mechanisms are released from the constrained state by moving the movable iron piece into contact with the lever mechanisms, and the movable contact point is separated from the fixed contact point, thereby opening the circuit, and the handle returns to the off position in conjunction with the lever mechanisms.

2. The circuit breaker as defined in claim 1, further comprises a lock member provided on a housing of the circuit breaker for constraining the handle in the on position.

3. The circuit breaker as defined in claim 2, wherein the lock member is a leaf spring that engages the handle in the on position.

4. The circuit breaker as defined in claim 2, wherein the lock member is a leaf-shaped lock member pivotably mounted on the handle, and the housing contains a lock recess that engages the leaf-shaped lock member when the handle is in the on position.

5. The circuit breaker as defined in claim 1, wherein the handle, lever mechanisms, movable iron piece and movable contact point are pivotably mounted on a housing of the circuit breaker.

6. The circuit breaker as defined in claim 1, wherein the fixed contact point, the electromagnetic trip coil and the electromagnetic holding coil are fixedly mounted on a housing of the circuit breaker.

7. The circuit breaker as defined in claim 6, wherein the electromagnetic trip coil and the electromagnetic holding coil are mounted adjacently such that the movable iron piece pivotably rotates between the first and second coils.

8. The circuit breaker as defined in claim 1, wherein the lever mechanisms comprise a first link pivotably joined to the handle by a first link shaft, a second link pivotably joined to the movable contact point by a second link shaft, wherein the first link and the second link are pivotably joined by a third link shaft, and a striker bar pivotably mounted to the first link by an integral bar shaft, and wherein the lever mechanisms are released from the constrained state when the movable iron piece contacts the striker bar when the movable iron piece is attracted to the first electromagnetic trip coil.

9. The circuit breaker as defined in claim 8, wherein the lever mechanisms are constrained in the on position with a cam lever pivotably mounted on the first link shaft, wherein the cam lever contains a lock recess that engages with a lock pin on the second link when the handle is in the on position.

* * * * *